US006108817A

United States Patent [19]

Kostelac

[11] Patent Number: 6,108,817

[45] Date of Patent: Aug. 29, 2000

[54] HAND-SHAPED NOVELTY HAND SIGN

[76] Inventor: Timothy J. Kostelac, 617 Splitlog, Kansas City, Kans. 66101

[21] Appl. No.: 09/002,206

[22] Filed: Dec. 31, 1997

Related U.S. Application Data

[60] Provisional application No. 60/033,994, Jan. 3, 1997.

[51] Int. Cl.[7] ..... A41D 13/08; A41D 25/00; A41D 19/00; A63H 33/00; A63H 3/14

[52] U.S. Cl. ..... 2/159; 2/16; 2/158; 446/26; 446/327; 40/586

[58] Field of Search ..... 2/16, 20, 21, 158, 2/159, 167; 446/26, 370, 327, 328, 397; 40/1, 538, 586; D2/613, 615, 616, 622, 612, 614, 617, 623, 999, 741; D3/1, 4, 215, 221, 254; D11/95, 99, 100, 101, 102, 104, 165, 166, 168, 172, 173, 174; D20/19, 29, 30, 31, 32, 33; 15/229.11, 227, 229.13, 244.1, 244.3, 1, 443

[56] References Cited

U.S. PATENT DOCUMENTS

| | | | |
|---|---|---|---|
| Re. 33,449 | 11/1990 | Martin . | |
| D. 159,662 | 8/1950 | Patek . | |
| 219,814 | 9/1879 | Hall . | |
| D. 313,496 | 1/1991 | Pesta . | |
| D. 322,633 | 12/1991 | Sweeting et al. . | |
| D. 347,658 | 6/1994 | Scapillato . | |
| D. 364,653 | 11/1995 | Boden | D21/64 |
| D. 364,654 | 11/1995 | Boden | D21/64 |
| D. 377,053 | 12/1996 | Williams . | |
| D. 378,869 | 4/1997 | Mikell . | |
| D. 380,285 | 7/1997 | Babcock . | |
| D. 394,229 | 5/1998 | Curry . | |
| 2,223,204 | 11/1940 | Carmichael . | |
| 2,319,873 | 5/1943 | Linz . | |
| 2,513,030 | 6/1950 | Lazarian . | |
| 2,586,608 | 2/1952 | Bryson . | |
| 2,653,601 | 9/1953 | Morrison . | |
| 2,687,729 | 8/1954 | Slavin . | |
| 2,729,023 | 1/1956 | Lerner et al. . | |
| 2,884,644 | 5/1959 | Jefferson . | |
| 3,707,012 | 12/1972 | Lane . | |
| 4,030,414 | 6/1977 | McGuire . | |
| 4,282,891 | 8/1981 | Duceppe . | |
| 4,397,754 | 8/1983 | Collishaw et al. . | |
| 4,441,271 | 4/1984 | Hutchinson | 40/584 |
| 4,445,507 | 5/1984 | Eisenberg . | |
| 4,454,204 | 6/1984 | Posey | 428/542.4 |
| 4,486,975 | 12/1984 | Harreld et al | 446/220 |
| 4,530,726 | 7/1985 | Montiel . | |
| 4,582,017 | 4/1986 | Ostermiller | 116/28 |
| 4,627,129 | 12/1986 | Wittes . | |
| 4,637,151 | 1/1987 | Love et al. | 40/584 |
| 4,772,020 | 9/1988 | Martin . | |
| 4,810,228 | 3/1989 | Huggins | 446/418 |
| 4,850,052 | 7/1989 | Matthews | 2/160 |
| 4,866,806 | 9/1989 | Bedford . | |
| 4,938,515 | 7/1990 | Fazio . | |
| 5,106,332 | 4/1992 | Segan et al. | 446/415 |
| 5,112,266 | 5/1992 | Hall | 446/422 |
| 5,412,830 | 5/1995 | Girardot et al. . | |

*Primary Examiner*—John J. Calvert
*Assistant Examiner*—Shirra L. Jenkins
*Attorney, Agent, or Firm*—Sonnenschein Nath and Rosenthal; Joseph A. Mahoney; Jennifer Hammond

[57] ABSTRACT

A novelty noisemaker and hand sign comprising a hand-shaped foam rubber body portion having a front panel and a rear panel. The invention has a vinyl plastic or other like material covering which is affixed continuously to said front panel. The rear panel contains five digit slits in a pattern such that the spectator can press his or her fingers into the slits to wear the novelty hand. The invention has an orifice in one of the comers of the bottom of said foam rubber body and a hand strap which is connected to the body through the orifice. The covering can be affixed with team logos, colors, slogans or the like such that the spectator can visually communicate his or her support.

9 Claims, 1 Drawing Sheet

HAND-SHAPED NOVELTY HAND SIGN

This application claims the benefit of U.S. Provisional Application No. 60/033,994, filed Jan. 3, 1997.

FIELD OF THE INVENTION

The present invention relates to a novelty noisemaker and hand sign and, more particularly, to a foam rubber hand-shaped novelty noisemaker that fits on one's hand and is worn by spectators at sporting events, political rallies and like events.

BACKGROUND OF THE INVENTION

"Foam Fingers" or foam rubber novelties in the shape of a hand representing "No. 1," "V for Victory" and the like, have traditionally been made with team colors or logos for use by spectators at sporting events. Additionally, various hand signs and color cards have been developed for spectator use. However, none of the foregoing combine the characteristics of the present invention. Thus, it should be appreciated that there is a need for hand-shaped novelty noisemakers which also serve as hand signs for team support.

SUMMARY OF THE INVENTION

The present invention is directed to a novelty noisemaker and hand sign comprising a hand-shaped foam rubber body having a front panel and a rear panel. The invention has a vinyl plastic or other like material covering which is affixed continuously to said front panel. The rear panel contains five digit slits in a pattern such that the spectator can press his or her fingers into the slits to wear the novelty device on the hand. The slits are of a configuration that the novelty device will fit hands of all sizes and can be removed without the use of the other hand. The invention may have a hole or orifice in one of the corners of the bottom of said foam rubber body and a hand strap which is connected to the body through the orifice. The covering can be affixed with team logos, slogans or the like such that the spectator can visually communicate his or her support.

Accordingly, it is one object of the invention to provide a hand-held, hand-shaped novelty device for spectators to visibly and audibly communicate their support to their team or the like.

Another object of this invention is to provide a novelty device constructed in such a fashion so as not to inhibit the user from clapping his or her hands.

It is another object of this invention to provide a novelty device constructed in such a fashion so that when it is worn and the hands are clapped, a noise is made which can be louder than the noise made by clapping bare hands.

These and other object features and advantages of the present invention will become more apparent to, and better understood by, those skilled in the relevant art from the following more detailed description of the preferred embodiments of the invention taken with reference to the accompanying drawings, in which like features are identified by like reference numerals.

DETAILED DESCRIPTION OF THE PREFERRED EMBODIMENT

Figure 1:
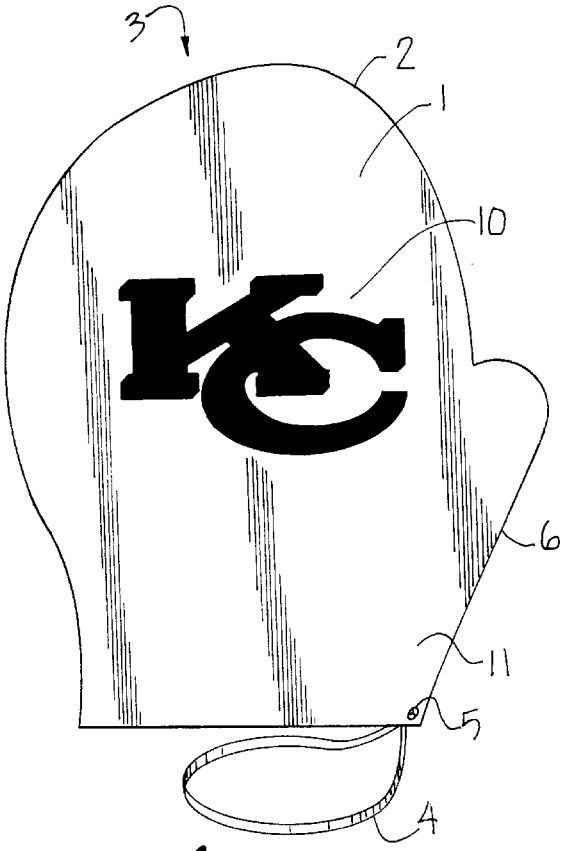
FIG. 1 is a front elevational view of the present invention.
Figure 2:
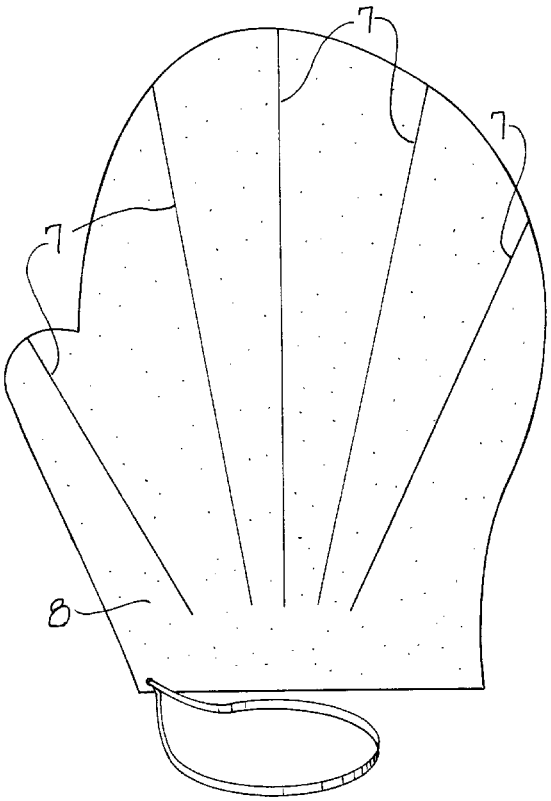
FIG. 2 is a rear elevational view of the present invention.
Figure 3:
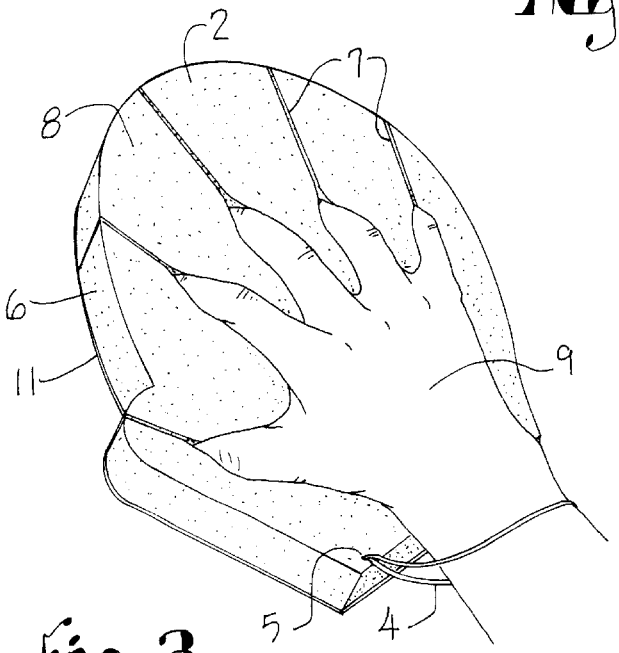
FIG. 3 is a rear perspective view of the present invention as worn by a spectator.

Referring to the accompanying drawings, the present invention relates to a hand held novelty device 3 that can be marketed as a hand sign, a noisemaker or simply a novelty item. As illustrated in FIGS. 1–3, the novelty device 3 is comprised of a one-piece body portion 2 having a front panel 1 and a rear panel 8. The body portion 2 is a one piece, hand-shaped, flexible foam member, but can be made in a variety of shapes and sizes. Body portion 2 is preferably made of flexible foam rubber latex, although any other flexible or rigid cellular plastics may be employed such as polyurethane, polyethylene, vinyl polymers, polystyrene, epoxy and polyvinyl chloride. Body portion 2 may be integrally colored with any of a variety of colors.

As illustrated in FIGS. 1–3, the novelty device 3 of the preferred embodiment is shaped like a large hand and has five digit slits 7 on the rear panel 8. The five digit slits 7 extend nearly the entire longitudinal length of the rear panel 8 of the novelty device 3. By extending across the entire length of the rear panel 8, the slits 7 are able to accommodate various finger lengths.

In order to accommodate the digits of a wearer, the one piece body portion 2 must be of sufficient thickness to allow the slits 7 to be of a depth to maintain one's digits tightly within the slits 7 of the rear panel 8 so that the novelty sign may be displayed in an upright position. In the preferred embodiment, the thickness of the body portion 2 is approximate 1 and ½ to 2 inches thick, but can vary depending upon the shape and size of the novelty item 3. While the slits in FIGS. 2 and 3 are shown to extend through the exterior edges 6 of the novelty device 3, it is not necessary that the slits 7 extend through to the exterior edge 6 of the novelty device 3. The slits 7 may begin and end entirely within the rear panel of the novelty device 3 and never reach the exterior edges 6 of the body portion 2.

As seen in FIG. 3, the novelty device 3 is worn by the wearer 9 by pressing his or her fingers into the slits 7, until his or her fingers are snugly positioned within the slits 7. While it is preferred that the device 3 be made with five digit slits 7, the device 3 could be made with a lesser number of slits 7. For example, providing a slit 7 for only one's thumb and one's little finger may be sufficient to give a wearer 9 a good grip on the novelty device 3.

Although FIGS. 1–3 depict a right-handed novelty device 3, the device 3 can, and is preferably, made to be worn on a wearer's left hand. Wearing the device 3 on the left hand frees one's right hand, which is the predominant hand of use for most individuals.

As illustrated by FIG. 1, a covering 11 extends almost entirely over and across the front panel 1 of the novelty device 3. Covering 11 is glued, heat sealed or otherwise affixed to front panel 1. The covering 11 is made preferably of a colored vinyl or cloth like material and is affixed continuously to the front panel 1; however, the covering may be made of other like materials (e.g., polyethylene film, metallized polyethylene film, nylon weave, glow-in-the-dark (luminescent) films, cotton-polyester weaves, denim, etc.). As demonstrated by FIG. 1, a slogan, logo, name or other like mark 10 may be affixed to the covering. The mark illustrated in FIG. 1 is a registered trademark of the Kansas City Chiefs Football Club, Inc.

As seen in all the figures, a hole 5 may be located in one of the bottom comers of the novelty device 3. A hand strap 4 may then be connected to the body 2 of the device 3 through the hole 5. The hand strap 4 is an optional feature which may be added to prevent loss of the novelty device 3 and to assist the wearer in carrying the device 3 when not in use.

Although the foregoing detailed description of the present invention has been described by reference to a single exemplary embodiment, and the best mode contemplated for carrying out the present invention has been shown and described, it is understood that modifications or variations in the structure and arrangement of this embodiment other than those specifically set forth herein may be achieved by those skilled in the art and that such modifications are to be considered as being within the overall scope of the present invention. Therefore, it is contemplated to cover the present invention and any and all modifications, variations or equivalents that fall within the true spirit and scope of the underlying principles disclosed and claimed herein. Consequently, the scope of the present invention is intended to be limited only by the attached claims.

I claim:

1. A novelty hand sign, comprising a body portion having a front panel and a rear panel, said rear panel having at least one digit slit cut into the rear panel of said body portion, said at least one digit slit having a sufficient depth for securing the sign to a wearer's hand when the sign is displayed in an upright position.

2. A novelty hand sign as recited in claim 1, wherein the rear panel of said body portion has five finger slits extending nearly the entire length of said body portion.

3. A novelty hand sign as recited in claim 1 further comprising a thin covering extending over and affixed to the front panel of said body portion.

4. A novelty hand sign as recited in claim 3, wherein said thin covering is made of a material that produces a noise louder than that made by the clapping of one's hands when worn on one hand of a user and clapped against the free hand of the user.

5. A novelty hand sign as recited in claim 3, wherein said thin covering comprises a material selected from the group consisting of polyethylene film, metallized polyethylene film, nylon weave, luminescent films, cotton-polyester weave and denim.

6. A novelty hand sign as recited in claim 1 wherein said body portion comprises a one-piece member made of foam rubber latex.

7. A novelty hand sign as recited in claim 1, wherein said body portion has two lower corners and a small hole located on at least one of the lower comers of said body portion, the hole in said body portion being positioned to accommodate a strap to fit around the wrist of a user when wearing said novelty hand sign.

8. A novelty hand sign, comprising:

(a) a one piece body portion having a front panel and a rear panel and being made of foam rubber latex, the rear panel of said body portion having five slits extending almost the entire length of said body portion and being positioned to receive the fingers of a user; and (b) a thin vinyl covering extending almost entirely over and across the front panel of said body portion.

9. A novelty hand sign as recited in claim 8, wherein said body portion has two lower corners and a small hole located on at least one of the lower comers of said body portion, the hole in said body portion being positioned to accommodate a strap to fit around the wrist of a user when wearing said novelty hand sign.

* * * * *